US006321034B2

(12) United States Patent
Jones-Lawlor et al.

(10) Patent No.: US 6,321,034 B2
(45) Date of Patent: Nov. 20, 2001

(54) PIVOTABLE HEATER

(75) Inventors: Heather Jones-Lawlor, Newton; Johnson Hsu, Framingham, both of MA (US)

(73) Assignee: The Holmes Group, Inc., Milford, MA (US)

( * ) Notice: Subject to any disclaimer, the term of this patent is extended or adjusted under 35 U.S.C. 154(b) by 0 days.

(21) Appl. No.: 09/729,987

(22) Filed: Dec. 5, 2000

Related U.S. Application Data

(60) Provisional application No. 60/169,074, filed on Dec. 6, 1999.

(51) Int. Cl.[7] ..... F24H 3/00

(52) U.S. Cl. ..... 392/367; 392/440; 219/476; 219/525; D23/380; D23/317; D23/335

(58) Field of Search ..... 392/367, 368, 392/366, 373, 440, 413; 219/478, 476–477, 537, 525; 416/120, 247 R, 246, 244 R, 175, 130; D23/317, 332–340, 380; 362/250, 227

(56) References Cited

U.S. PATENT DOCUMENTS

| | | | | |
|---|---|---|---|---|
| D. 101,740 | * | 10/1936 | Kirsch | D23/380 |
| D. 328,786 | * | 8/1992 | Obson | D23/380 |
| 1,686,024 | * | 10/1928 | Meyer | 392/384 |
| 2,523,353 | * | 9/1950 | Boester | 219/525 |
| 2,626,742 | * | 1/1953 | Turner | 416/120 |
| 2,853,591 | * | 9/1958 | Fine | 392/381 |
| 4,302,800 | * | 11/1981 | Pelletier | 362/250 |
| 4,703,152 | | 10/1987 | Shih-Chin . | |
| 5,403,162 | * | 4/1995 | Chen | 416/246 |
| 5,658,130 | | 8/1997 | Goldstein et al. . | |
| 5,720,594 | | 2/1998 | Snow . | |
| 5,790,748 | * | 8/1998 | Tamhane | 392/366 |
| 6,130,991 | * | 10/2000 | Chapman | 239/553.3 |

FOREIGN PATENT DOCUMENTS

476657 * 5/1929 (DE) .

* cited by examiner

*Primary Examiner*—John A. Jeffery
(74) *Attorney, Agent, or Firm*—Hoffmann & Baron, LLP; Francis E. Marino

(57) ABSTRACT

A heater comprising two or more heating units which are rotatably attached to each other about a common axis. Preferably, each heating unit is rotatably attached to the next successive heating unit along a vertical axis by a flanged coupling. Alternatively, each heating unit is rotatably attached to the next successive heating unit along a vertical axis by a pin and slot arrangement. Each of the heating units include a housing having at least one opening and a heater element within the housing.

22 Claims, 9 Drawing Sheets

PIVOTABLE HEATER

CROSS-REFERENCE TO RELATED APPLICATIONS

This application claims the benefit of U.S. Provisional Application No. 60/169,074, filed Dec. 6, 1999.

BACKGROUND OF THE INVENTION

1. Field of the Invention

The present invention relates to portable heaters which are rotatable such that the flow of heat can be directed in any desired direction.

2. Brief Discussion of the Prior Art

Portable heaters are intended to be placed on floors, counters or other surfaces. When desired, these heaters can be easily moved from one place to another. These devices often comprise a housing which is fixedly mounted or integrally formed on a supporting base. Because of the mounting arrangement of the housing on the supporting base, the angular zone covered by the emitted air is fixed. With these style heaters, when the user wishes to alter the angular zone of the emitted air, the user must reposition the heater so as to face the area intended to be heated.

It has been proposed, in U.S. Pat. No. 4,703,152 to provide a heater with an oscillating mechanism. The use of an oscillating mechanism on a standard heater enables the user to alter or enlarge the angular zone of the emitted air such that a greater area is capable of being covered by the heater. However, there still remains a drawback to this style of heater, in that, as the heater oscillates from side to side, the side from which the heater moved no longer obtains the benefit of the emitted heat until the heater returns to that side. Also, the angular zone of the emitted air is fixed and cannot be altered by the user.

Other style portable heaters have been proposed wherein the heat is emitted from all sides of the heater simultaneously. These portable heaters are typically circular in design and emit heat in a 360° pattern. This style heater is designed to be placed in the center of a room such that the entire room can be heated from one location. Although this heater style is effective in heating large rooms where the heater can be located remote from furniture and other flammable objects, it is less useful in smaller rooms because of the potential for heating unintended objects such as furniture or the walls. Similar to the oscillating heater, the circular heater emits air in a fixed zone which cannot be altered by the user.

Therefore, there still remains the need to provide a heater which allows the user to easily alter the angular zone of the emitted heat without depriving any of the intended area a continuous supply of heat.

SUMMARY AND OBJECTS OF THE INVENTION

It is an object of the present invention to provide a heater which has two or more separate heating units which can cause heat to flow in different directions if desired.

It is a further object of the present invention to provide a heater which is portable and easy to use.

The heater of the present invention comprises two or more heating units which are rotatably attached to each other about a common axis. Each of the heating units include at least a housing having at least one opening and a heater element within the housing. In a preferred form of heater, a blower in fluid communication with the heater element is provided. The blower blows air past the heater element and out of the opening in the housing.

In the preferred embodiment, the heater includes a motor having a shaft. The shaft is coupled to the blowers of each heating unit so that actuation of the motor operates each blower simultaneously. Preferably, the longitudinal axis of the shaft is the common axis about which the heating units are rotatably attached. Alternatively, each blower can have its own motor.

In an additional embodiment, the heater of the present invention includes an oscillating mechanism which allows for the automatic rotation of the heating units with respect to each other about the common axis. Preferably, each heating unit is independently rotatable with respect to the other heating units.

DETAILED DESCRIPTION OF THE INVENTION

The present invention is described below as having two heating units rotatably attached to each other about a common axis. This disclosure is in no way intended to be limited to a heater having only two heating units rotatably attached to each other, and modification of the present heater to include more than two heating units will be readily apparent to one skilled in the art given the following detailed description.

Figure 1:
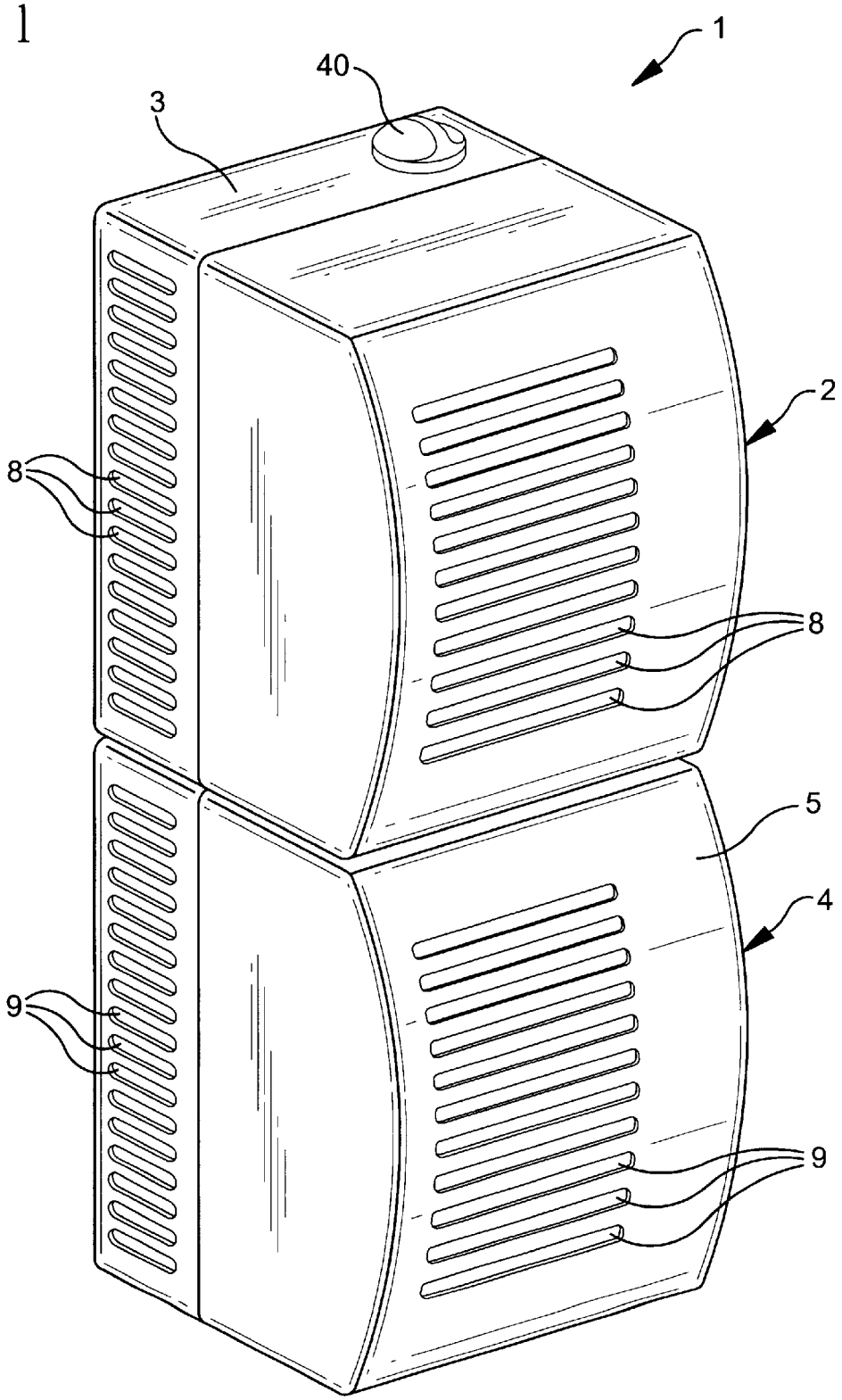
FIG. 1 is a perspective view of a first embodiment of the heater of the present invention.
Figure 2:
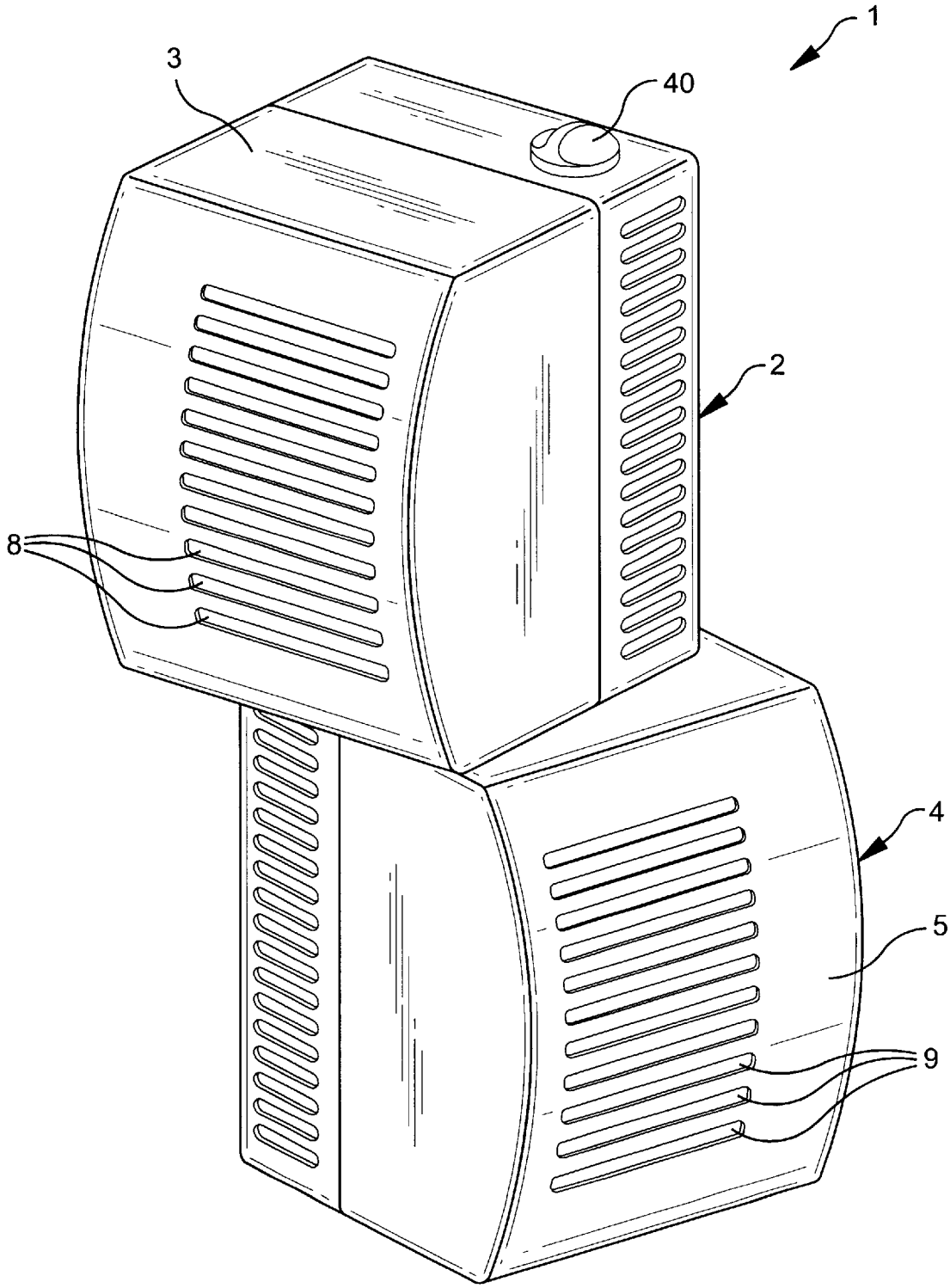
FIG. 2 is a perspective view of the heater of FIG. 1 wherein the heating units have been rotated with respect to each other.
Figure 3:
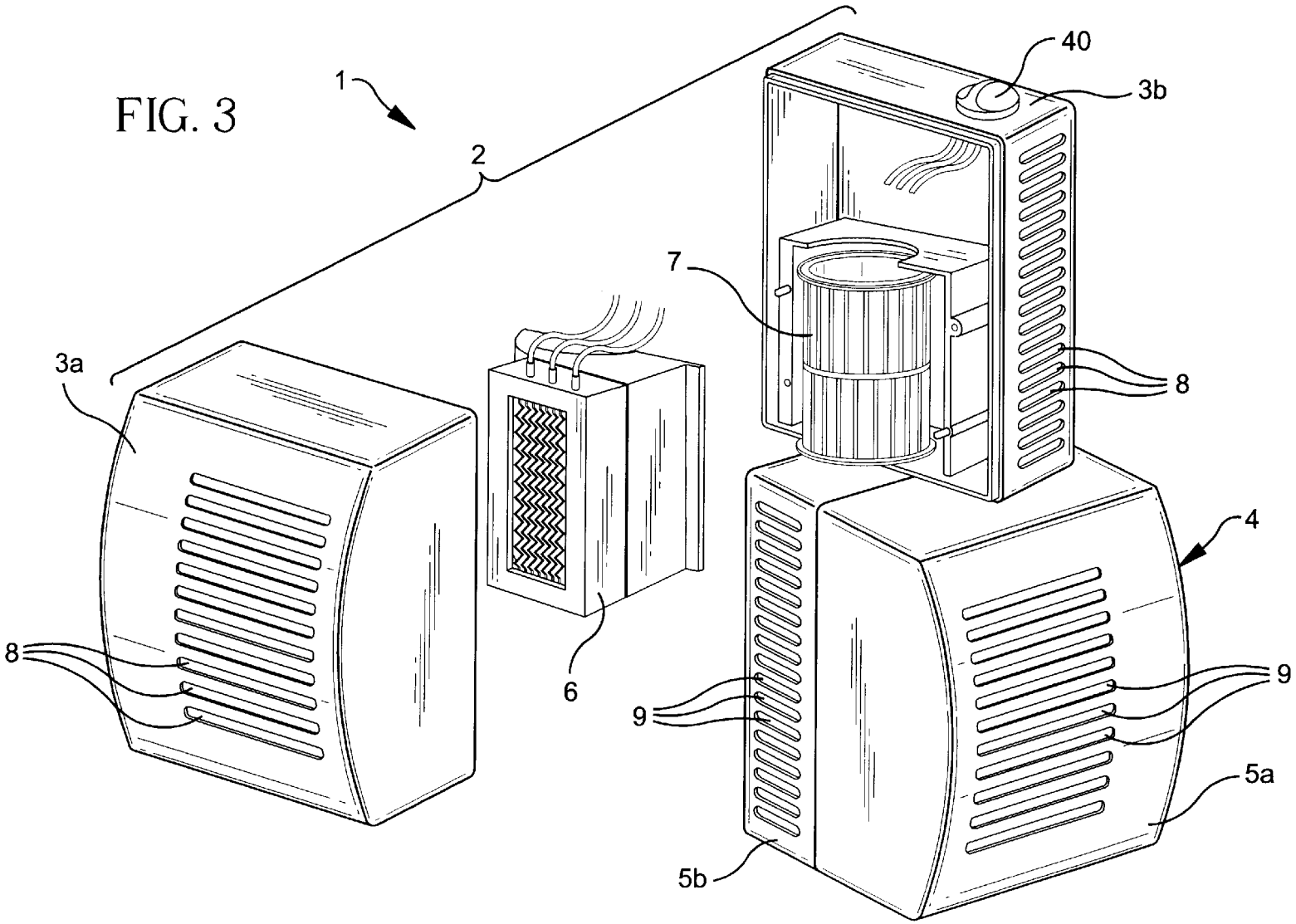
FIG. 3 is a partially exploded perspective view of the components of the heating unit of the present invention.

Referring now to the drawings, FIGS. 1–3 show the heater, generally referred to as 1, of the present invention. The heater 1 comprises two or more heating units (2, 4) which are rotatably attached to each other about a common axis. Preferably, each heating unit is independently rotatable with respect to the other heating units comprising the heater of the present invention.

Each heating unit (2, 4) includes a housing (3 and 5, respectively) having at least one opening (8 and 9, respectively). As shown in FIG. 3, the housing (3, 5) is preferably formed in two separate sections (3*a*, 3*b* and 5*a*, 5*b*, respectively) which are secured together after the heating and electrical components are placed in their proper locations within the housing (3, 5). The openings in the rear section 3*b*, 5*b* are inlet openings while those in the front section 3*a*, 5*a* are outlet openings. The housings and openings can be different in configuration from designed as grilles, covered with wire mesh, not covered at all, or designed in any manner which will allow air to flow therethrough. Securing of the housing sections can be accomplished in any means known in the art, such as screws, glue, or a friction-fit, to name a few.

As seen more clearly in FIG. 3, each heating unit (2, 4) includes a heat source within the housing. Preferably, the heat source comprises an electrically driven heater element 6. In the preferred forced air heater shown in FIG. 3, a blower 7 is in fluid communication with the heating element 6, and blows air past the heater element 6 and out of the at least one opening (8, 9) in the housing (3, 5). It will be readily apparent to one of ordinary skill in the art that there are other known heat sources that can be used with the present invention. For example, in radiant heaters a blower is not required, but instead, only a radiant heating element is needed. Additional types of heat sources include plate heaters and coil heaters, to name a few.

The blower 7 used in conjunction with the preferred form of the present invention can be any means which forces air past the heat source and through the at least one opening (8, 9) in the housing. Such blowers include fans and "squirrel cage" blowers (shown in FIG. 3). Similar to the heat source, one of skill in the art will recognize that there are many variations to the style and type of blower which can be used with the present invention. Typically, however, the style and type of blower used will be matched with the style and type of heat source used.

Figure 4:
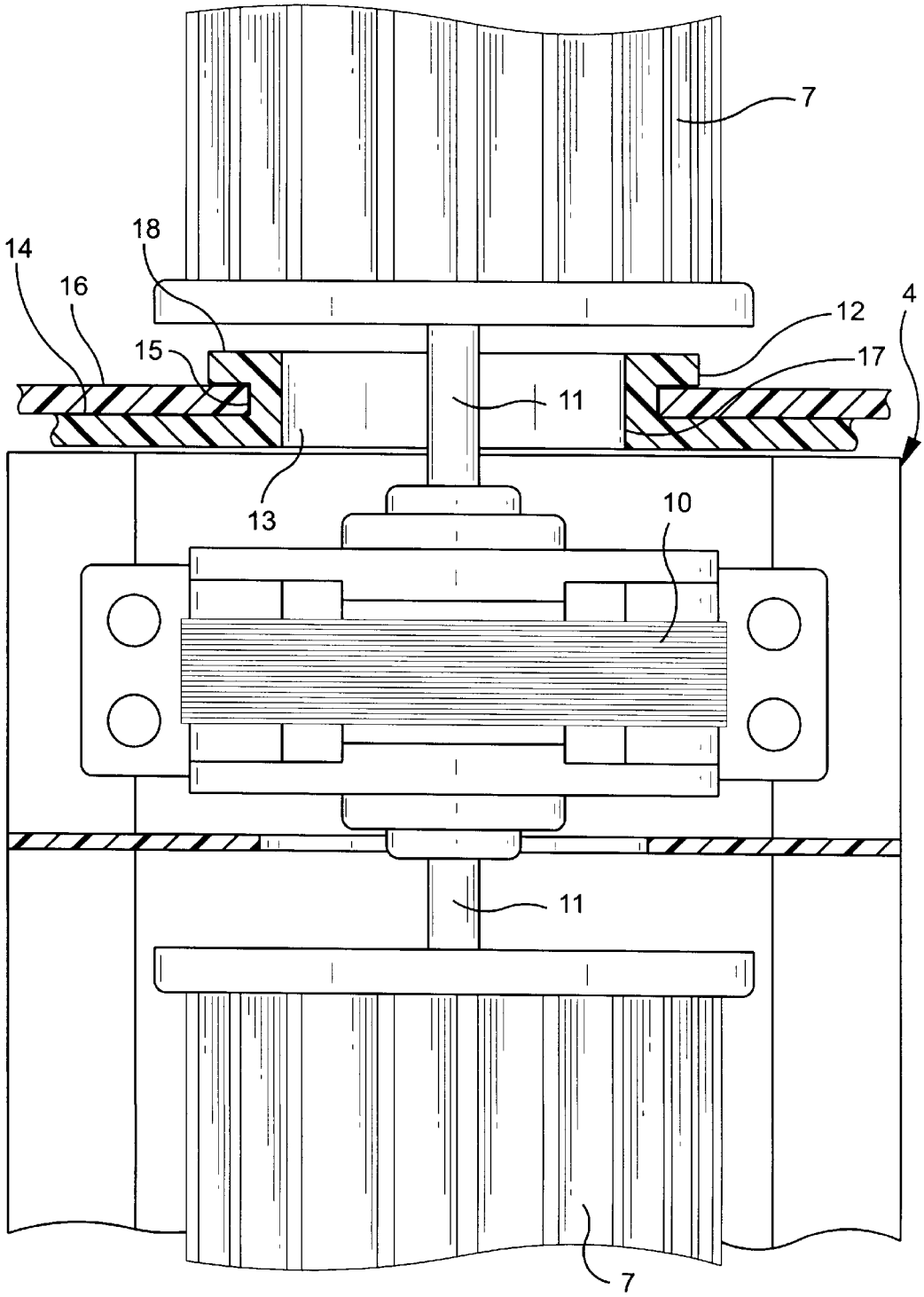
FIG. 4 is a partial cross-sectional view detailing the motor and blowers of the present invention.

In the preferred embodiment, as shown in FIG. 4, the heater 1 includes a motor 10 having a shaft 11. The shaft 11 is coupled to the blowers 7 of each heating unit (2, 4) so that actuation of the motor 10 operates each blower 7 simultaneously. Preferably, the longitudinal axis of the shaft 11 is the common axis about which the heating units 2 and 4 are rotatably attached. Alternatively, each blower 7 can have its own motor 10 (not shown). Preferably, the motor used with the present invention is located within the housing of the heater unit. This enables the housing to be aesthetic in design by concealing all of the working components of the heater therein. If one of the heating units is intended for use as a base, such as the unit 4 shown in FIGS. 1–2, the motor is provided in that heating unit to enhance stability. It will be appreciated that the motor used with the present invention can be any conventional electrically driven motor which is capable of rotating a shaft, such motors being known in the art.

Figure 5:
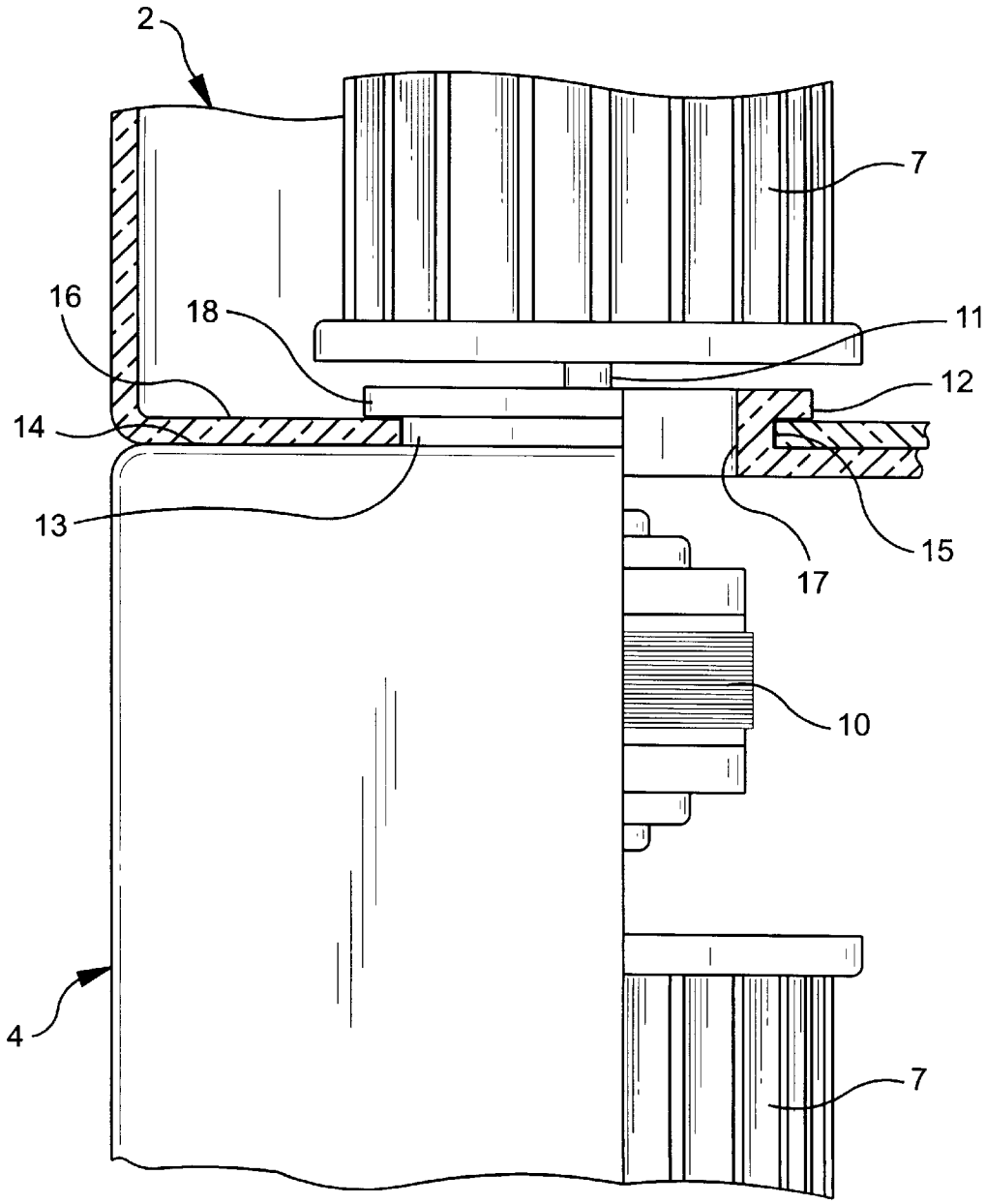
FIG. 5 is a partial cross-sectional view of a coupling for the heating units of the present invention.

As stated above, the heater 1 comprises two or more heating units which are rotatably attached to each other about a common axis. Referring now to FIGS. 4 and 5, in a first embodiment, each heating unit is rotatably attached to the next successive heating unit along a vertical axis by a flanged coupling 12. The flanged coupling 12 comprises an annular rim 13 which extends from the top surface 14 of the lower heating unit housing 5 through an aperture 15 located in the bottom surface 16 of the heating unit housing 3 positioned directly above the lower heating unit. The annular rim 13 further includes a radially extending flange 18. The flange 18 operates to secure the housing of the lower heating unit to the housing of the upper heating unit such that the housings cannot be separated.

Preferably, and as shown in FIGS. 4 and 5, the inside diameter of the annular rim 13 of the lower heating unit defines an aperture 17 in the lower heating unit. The apertures 15 and 17 cooperate to provide a passageway for the shaft 11 of the motor 10, such that a single motor can be used to drive all of the blowers 7, as described above.

Although the coupling of the lower heating unit to the upper heating unit has been described as a flanged coupling which extends from the lower unit into the upper unit, it is possible to reverse the components of the coupling such that the annular rim descends from the upper heating unit into an aperture on the lower heating unit. Additionally, the coupling used does not have to be a flanged coupling as described above, but rather can be any coupling which will allow the heating units to pivot or rotate with respect to each other.

Figure 6:
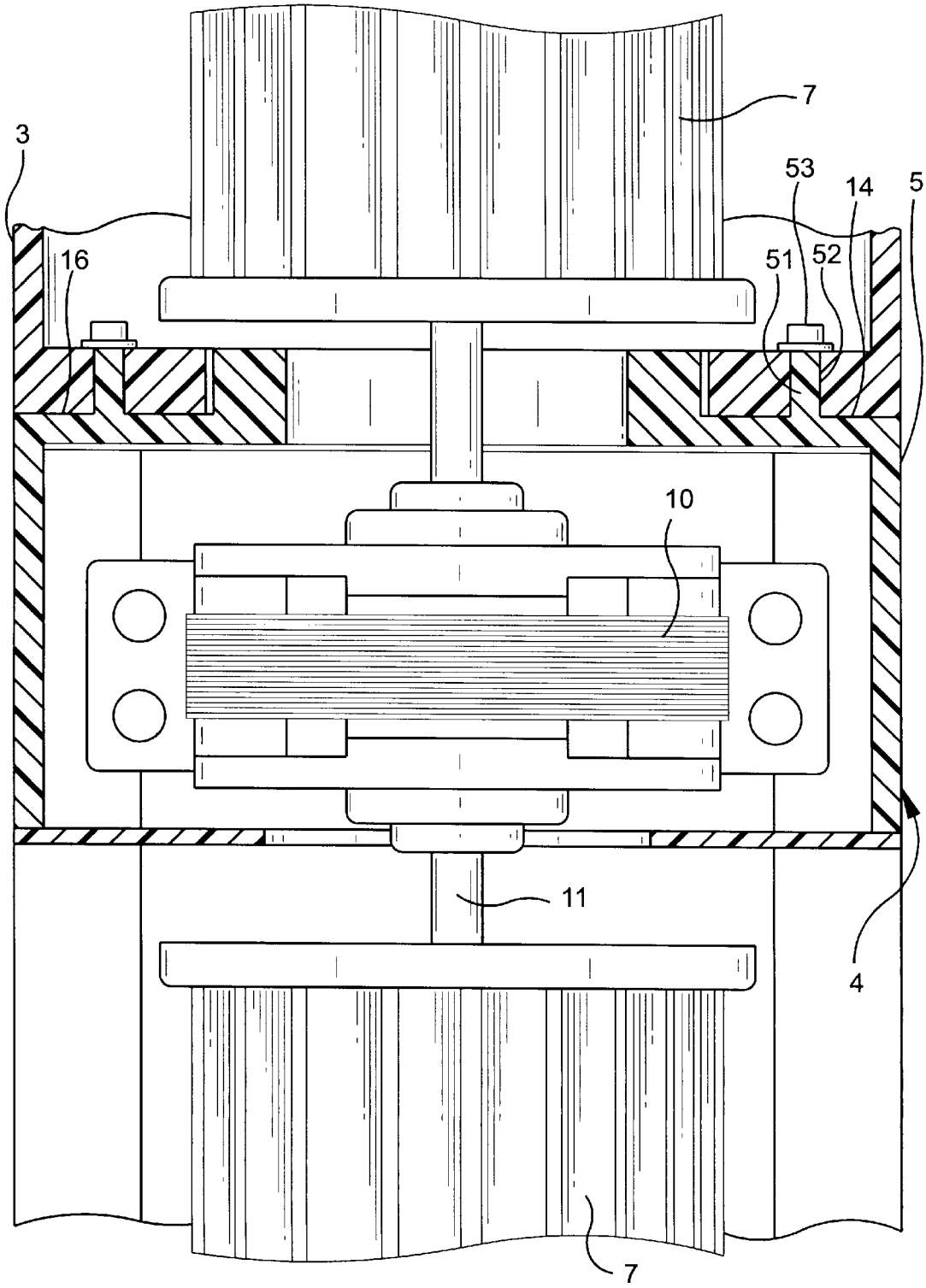
FIG. 6 is a partial cross-sectional view showing an alternate embodiment for coupling the heating units of the present invention.
Figure 7:
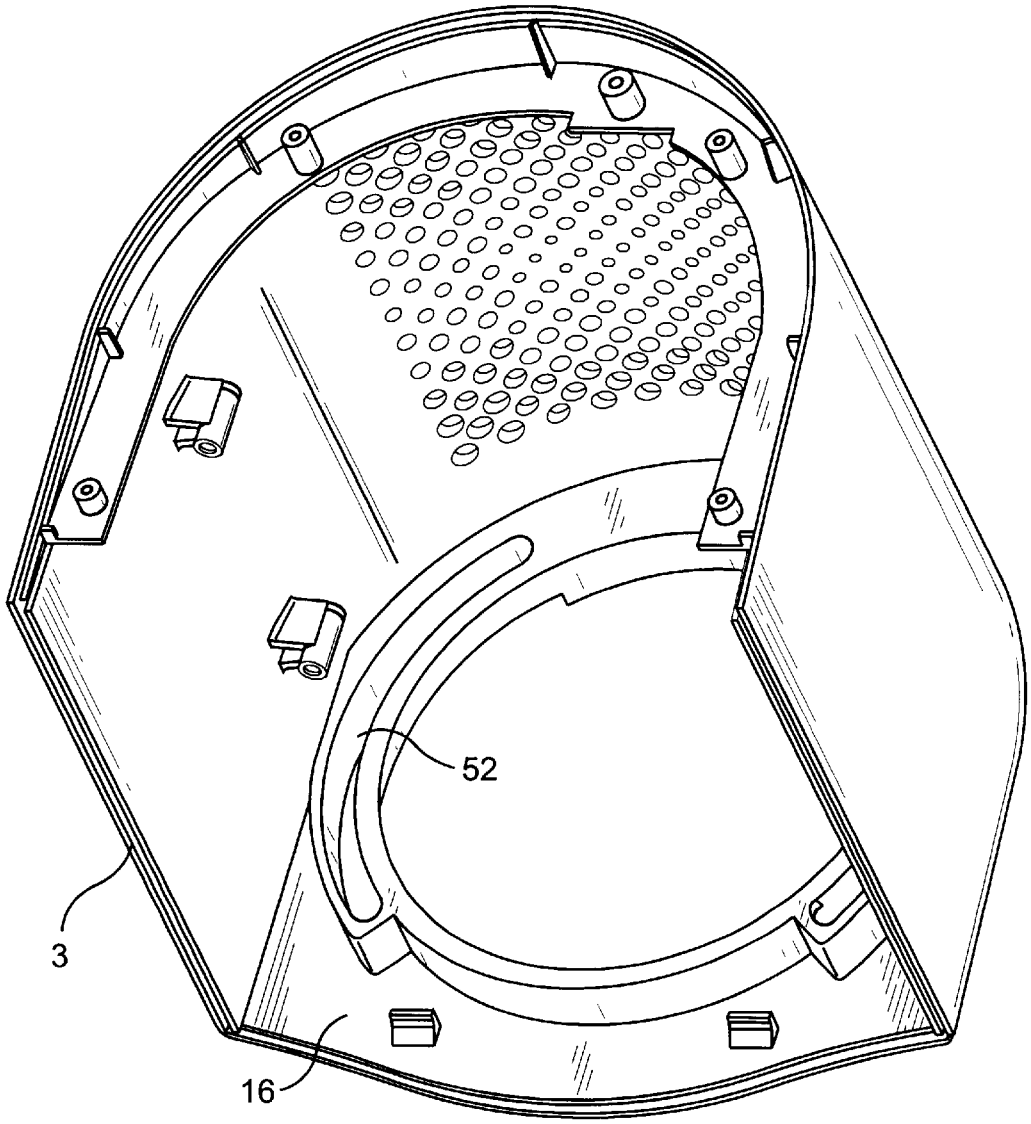
FIG. 7 is a perspective view of the upper heating unit housing shown in FIG. 6.

For example, an alternate embodiment of the coupling is shown in FIGS. 6 and 7. Instead of a flanged coupling, a pin and slot arrangement 50 is provided. The pin and slot arrangement 50 comprises at least one pin 51 extending from the top surface 14 of the lower heating unit housing 5 through at least one curved slot 52 formed in the bottom surface 16 of the heating unit housing 3 positioned directly above the lower heating unit. The length of the curved slot 52 therefore determines the range of rotation of the housings with respect to each other. A bolt 53 is threaded into the pin 51 to secure the housing of the lower heating unit to the housing of the upper heating unit such that the housings cannot be separated. Again, it is possible to reverse the components of the pin and slot arrangement such that the pin descends from the upper heating unit into a curved slot formed in the lower heating unit.

Figure 8:
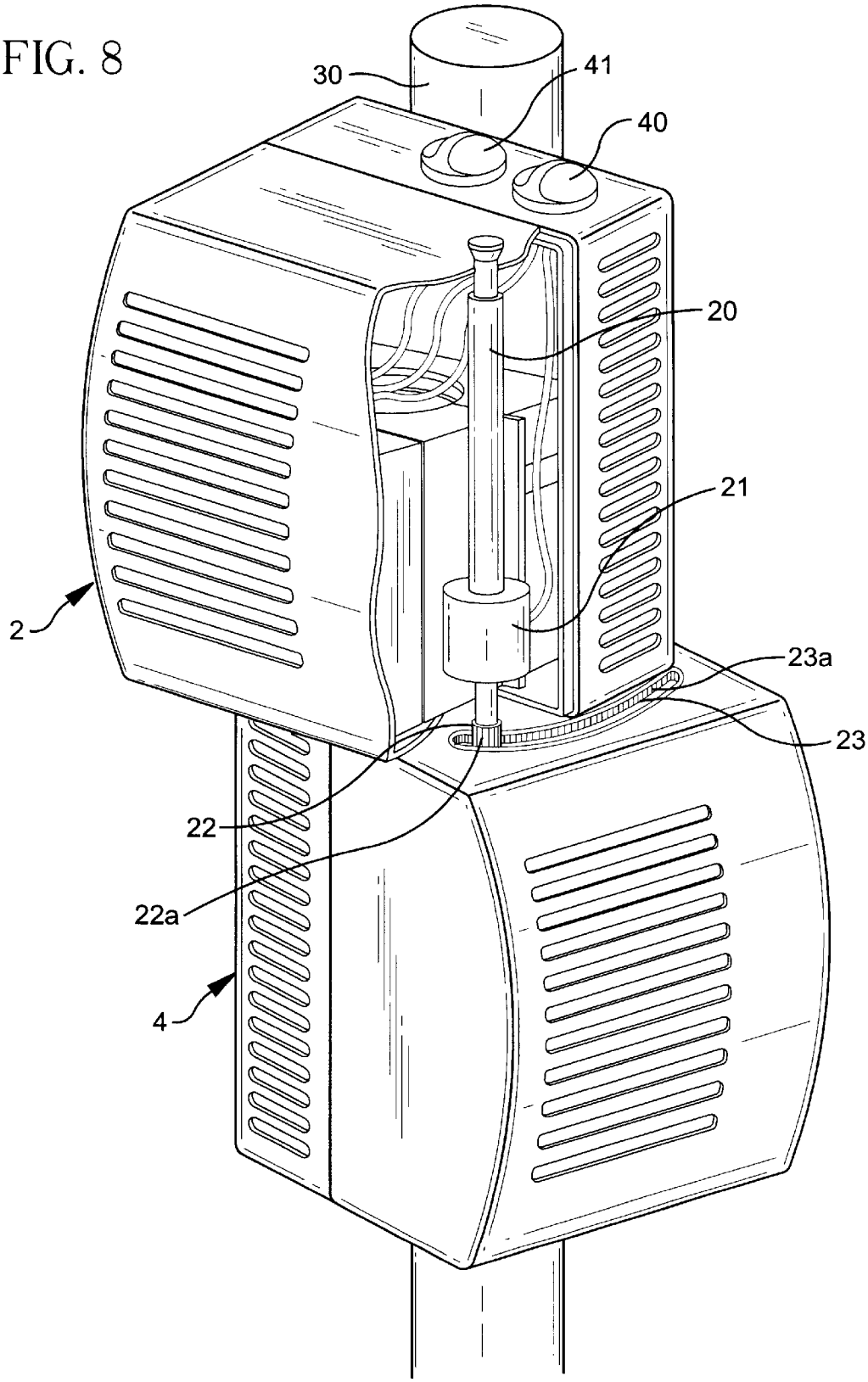
FIG. 8 is a partial cut-away view of an oscillating mechanism for the heating units of the present invention.

In another alternative embodiment, as shown in FIG. 8, the heater 1 of the present invention includes an oscillating mechanism 20. Such a mechanism converts an input motion, such as a circular or rotary motion from a motor, into oscillation. For the purposes of this discussion, oscillation will be understood to refer to a repetitive motion which causes the heating units to discharge heat in a repeating pattern of directions. Within the context of a heater, oscillation is a motion wherein the heater units' rotational axis sweeps through an arc, subsequently moving in reverse direction through the same arc, returning to its original position.

The oscillating mechanism 20 comprises a motor 21, a gear 22 having a plurality of teeth 22*a*, and a track 23 having a plurality of teeth 23*a*. As shown in FIG. 8, the motor and the gear are attached to the upper heating unit 2, the track is provided on the top surface 14 of the lower heating unit, and the gear 22 is positioned within the track 23. The actuation of the motor 21 causes the relative rotation of the gear 22 such that the teeth 22*a* of the gear 22 engage the teeth of the track 23*a* and force the gear 22 to follow the pattern of the track 23. Due to the fact that the motor and gear are attached to the upper heating unit, the movement of the gear within the track will cause the upper heating unit to oscillate with respect to the lower heating unit. When the gear 22 reaches the limit of the track, the motor will change direction and force the gear 22 to move in the reverse direction as that previously traveled within the track 23. This pattern will repeat until power to the oscillation motor 21 is removed. This oscillating mechanism 20 allows for the automatic rotation of the heating units with respect to each other about their common axis.

The oscillating mechanism described above is but one mechanism which can be effectively utilized to oscillate the heating units with respect to each other. Other mechanisms can alternatively effectively provide for oscillation of the heater units of the present invention.

In the preferred embodiment of the present invention, as shown in FIGS. 1–3, the lower heating unit 4 defines a base for supporting all of the heating units in a vertically oriented configuration. In other words, the bottom-most heating unit has rotatably mounted atop of it at least one other heating unit. This configuration of the present invention can be further expanded to include additional heating units rotationally attached to one another until the desired number of heating units is obtained.

Figure 9:
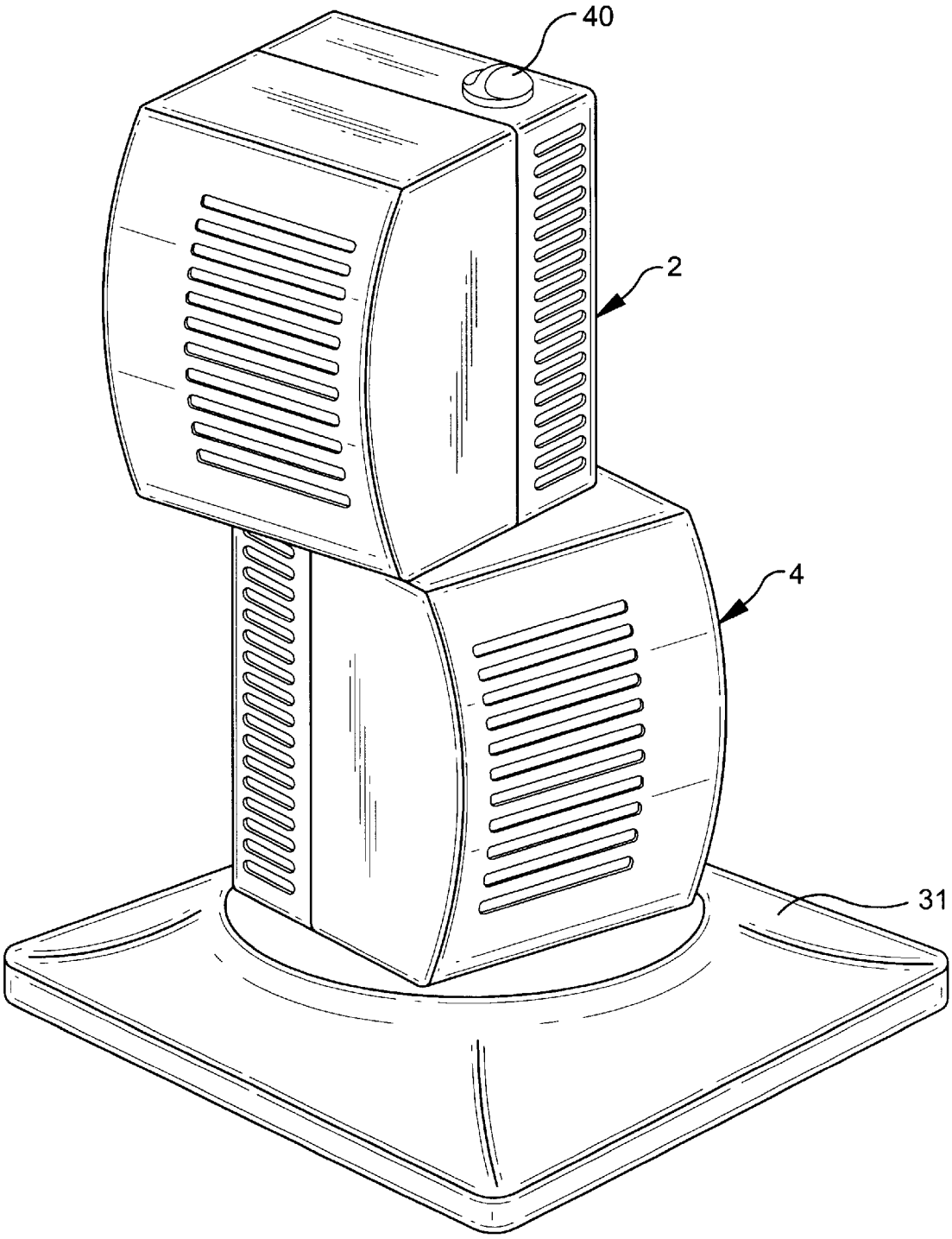
FIG. 9 is a perspective view of the heater of the present invention mounted to a base.

In still a further embodiment, as shown in FIGS. 8 and 9, the heater of the present invention is provided with a support member in addition to the heating units 2 and 4. As shown in FIG. 8, the support member can be designed as a pole 30 wherein one of the heating units 2 or 4 is either fixedly or rotationally attached thereto.

Alternatively, as shown in FIG. 9, the support member can be designed as a base 31 which is positioned beneath the lower heating unit 4 so as to raise the heater above the plane of the surface upon which it is to be supported. The lower heating unit can be fixedly or rotationally attached to the base 31. When the lower heating unit is rotationally attached to the base 31, each heating unit is capable of rotating with respect to the other units and the base 31.

As is typical of portable heaters, power is conducted to the heat source and blower from a power cord and plug (not shown). The components required to enable operation of a heater with a power cord and plug are well known in the art and need not be discussed in detail herein. As shown in FIGS. 1–3 and 8–9, at least one operator's on/off switch 40 is provided. The on/off switch 40 can be a simple single-speed selection switch which has only an ON and an OFF selection, or the switch can be a multiple setting switch having ON, HIGH, LOW, MEDIUM and OFF selections, or any combination of these. The blowers may be operated with or without actuating the heating elements. The operator's on/off switch 40 can be arranged to control all heat sources simultaneously, or a separate switch can be provided for each heat source of each heating unit.

As shown in FIG. 8, a second on/off switch 41 controls the optional oscillation mechanism 20. Similar to the operator's switch 40, the oscillation switch 41 can be a simple on/off switch or it can be a multiple setting switch. Additionally, all of the switches used in conjunction with the present invention can be touch, toggle, dial or button operated, the selection of switch type being a matter of design and cost considerations.

Thus, while the foregoing detailed description has disclosed what is presently believed to be the preferred embodiments of the invention, those skilled in the art will appreciate that other and further changes and modifications can be made without departing from the scope or spirit of the invention, and it is intended that all such other changes and modifications are included in and are within the scope of the invention as described in the appended claims.

What is claimed is:

1. A heater comprising:

two or more heating units, said heating units rotatably attached to each other about a common axis by a flanged coupling, said heating units each including:

a housing including at least one opening; and a heater element within the housing.

2. The heater according to claim 1, wherein each heating unit further includes a blower in fluid communication with said heater element for blowing air past said heater element and out of said housing through said opening.

3. The heater according to claim 2, further including a motor having a shaft which is coupled to the blowers of each heating unit, such that the actuation of the motor operates each blower simultaneously.

4. The heater according to claim 3, wherein the longitudinal axis of the shaft is the common axis about which the heating units are rotatably attached.

5. The heater according to claim 2, wherein each blower includes a motor.

6. The heater according to claim 1, further comprising a support member attached to one of the heating units.

7. The heater according to claim 6, wherein the support member is a pole, said one of the heating units being rotatably attached to the pole.

8. The heater according to claim 6, wherein the support member is a base, said one of the heating units being rotatably attached to the base.

9. The heater according to claim 1, wherein one of said heating units defines a base for supporting all of said heating units in a vertically oriented configuration.

10. A heater comprising:

two or more heating units, said heating units rotatably attached to each other about a common axis by a pin and slot arrangement, said heating units each including:

a housing including at least one opening; and a heater element within the housing.

11. A heater comprising:

two or more heating units, said heating units rotatably attached to each other about a common axis, said heating units each including:

a housing including at least one opening; and a heater element within the housing, the heater further comprising an oscillating mechanism positioned between each heating unit, said oscillating mechanism rotating the heating units with respect to each other about the common axis.

12. A heater comprising:

a first heating unit, said first heating unit including a first housing having at least one first opening and a first heater element within the housing; and a second heating unit rotatably attached to the first heating unit about a common axis by a flanged coupling, said second heating unit including a second housing having at least one second opening and a second heater element within the housing.

13. The heater according to claim 12, wherein said first heating unit includes a first blower in fluid communication with said first heater element for blowing air past said first heater element and out of said first housing through said first opening and said second heating unit includes a second blower in fluid communication with said second heater element for blowing air past said second heater element and out of said second housing through said second opening.

14. The heater according to claim 13, further including a motor having a shaft which is coupled to the first blower and the second blower, such that the motor operates the first blower and the second blower simultaneously.

15. The heater according to claim 14, wherein the longitudinal axis of the shaft is the common axis about which the first heating unit and the second heating unit are rotatably attached.

16. The heater according to claim 13, wherein each blower includes a motor.

17. The heater according to claim 12, further comprising a support member rotatably attached to the first heating unit.

18. The heater according to claim 17, wherein the support member is a pole.

19. The heater according to claim 17, wherein the support member is a base.

20. The heater according to claim 12, wherein the first heating unit defines a base for supporting the second heating unit in a vertically oriented configuration.

21. A heater comprising:

a first heating unit, said first heating unit including a first housing having at least one first opening and a first heater element within the housing; and a second heating unit rotatably attached to the first heating unit about a common axis by a pin and slot arrangement, said second heating unit including a second housing having at least one second opening and a second heater element within the housing.

22. A heater comprising:

a first heating unit, said first heating unit including a first housing having at least one first opening and a first heater element within the housing;

a second heating unit rotatably attached to the first heating unit about a common axis, said second heating unit including a second housing having at least one second opening and a second heater element within the housing; and an oscillating mechanism for rotating the heating units with respect to each other about the common axis.

* * * * *

UNITED STATES PATENT AND TRADEMARK OFFICE

CERTIFICATE OF CORRECTION

PATENT NO. : 6,321,034 B2
DATED : March 27, 2002
INVENTOR(S) : Jones-Lawlor et al.

It is certified that error appears in the above-identified patent and that said Letters Patent is hereby corrected as shown below:

Column 3,
Line 2, now reads "configuration from designed" should read -- configuration from those shown for functional and/or aesthetic purposes. For example, the openings can be designed --

Signed and Sealed this

Third Day of September, 2002

*Attest:*

*Attesting Officer*

JAMES E. ROGAN
*Director of the United States Patent and Trademark Office*